US007172260B2

(12) United States Patent
Yoshida et al.

(10) Patent No.: US 7,172,260 B2
(45) Date of Patent: Feb. 6, 2007

(54) LIQUID SPRAYING METHOD, LIQUID SPRAYING SYSTEM, AND LIQUID SPRAYING EXECUTE PROGRAM

(75) Inventors: Atsushi Yoshida, Nagano-ken (JP); Masaru Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/378,071

(22) Filed: Mar. 4, 2003

(65) Prior Publication Data

US 2003/0214542 A1 Nov. 20, 2003

(30) Foreign Application Priority Data

| | | |
|---|---|---|
| Mar. 4, 2002 | (JP) | 2002-057974 |
| Mar. 4, 2002 | (JP) | 2002-057975 |
| Feb. 28, 2003 | (JP) | 2003-054864 |
| Feb. 28, 2003 | (JP) | 2003-054865 |

(51) Int. Cl.
*B41J 2/195* (2006.01)

(52) U.S. Cl. ..... 347/7; 347/19; 347/84

(58) Field of Classification Search ..... 347/7, 347/19, 84, 85, 86, 9, 10
See application file for complete search history.

(56) References Cited

U.S. PATENT DOCUMENTS

| | | | | |
|---|---|---|---|---|
| 4,929,979 | A | 5/1990 | Kimoto et al. | |
| 5,663,750 | A * | 9/1997 | Sakuma | 347/7 |
| 6,106,108 | A * | 8/2000 | Cluet | 347/84 |
| 6,447,084 | B1 * | 9/2002 | Uetsuki et al. | 347/7 |
| 6,771,378 | B2 | 8/2004 | Akiyama et al. | |

FOREIGN PATENT DOCUMENTS

| | | | |
|---|---|---|---|
| JP | 1-194669 | A | 4/1989 |
| JP | 03-110973 | A | 5/1991 |
| JP | 04-229790 | A | 8/1992 |
| JP | 07-030758 | A | 1/1995 |
| JP | 7-276662 | A | 10/1995 |
| JP | 8-118675 | A | 5/1996 |
| JP | 8-238780 | | 9/1996 |
| JP | 10-166622 | | 6/1998 |
| JP | 10-202902 | | 8/1998 |
| JP | 11-099670 | A | 4/1999 |
| JP | 11-227173 | A | 8/1999 |
| JP | 11-320910 | | 11/1999 |
| JP | 2000-071582 | A | 3/2000 |
| JP | 2000-103083 | | 4/2000 |
| JP | 2000-225720 | A | 8/2000 |
| JP | 2001-293855 | A | 10/2001 |

* cited by examiner

*Primary Examiner*—Stephen Meier
*Assistant Examiner*—Lam Nguyen
(74) *Attorney, Agent, or Firm*—Sughrue Mion, PLLC

(57) ABSTRACT

A printing system has a recording head, an ink cartridge and a computer. The recording head has a nozzle. The ink cartridge sprays the ink from the nozzle to a paper in accordance with a printing procedure. The computer detects the remaining amount of ink in the ink cartridge. The computer detects whether the remaining amount of ink is less than or equal to a predetermined reference value. The computer calculates usage required for the printing procedure of the ink when the remaining amount is determined to be less than or equal to the reference value. The computer compares the detected remaining amount of the ink when the remaining amount of ink is determined to be less than or equal to the reference value with the calculated usage.

15 Claims, 9 Drawing Sheets

LIQUID SPRAYING METHOD, LIQUID SPRAYING SYSTEM, AND LIQUID SPRAYING EXECUTE PROGRAM

BACKGROUND OF THE INVENTION

The present invention relates to a liquid spraying method, a liquid spraying system, and a liquid spraying execute program.

A typical liquid spraying apparatus for spraying liquid to a target includes an ink jet printer for printing an image and the like by spraying ink droplets onto a sheet of paper. Such a printer is sometimes interrupted or colors are changed during printing due to ink shortage. To solve these problems, Japanese Laid-Open Patent Publication No. 10-166622 discloses a printer that includes a central processing unit (CPU). The CPU judges, before printing, whether each color of ink has a sufficient amount to be used for printing. More specifically, the CPU detects the remaining amount of ink in each ink cartridge and estimates the ink usage of each color of ink, based on the data to be printed. The CPU then compares the detected remaining amount of each ink with the estimated ink usage. As a result of the comparison, all the printing is performed when the remaining amount of each color of ink is greater than or equal to the estimated ink usage. The CPU analyzes the data to be printed and calculates the number of operations of the recording head driven during printing. The CPU multiplies the number of operations of the recording head by the spraying amount of each color of ink. Accordingly, the estimated ink usage of each color of ink is obtained.

Since the number of operations of the recording head of each color of ink during printing is enormous, the calculation of the estimated ink usage applies a great load on the CPU. Therefore, it takes a long time to determine whether the ink amount is sufficient. Thus, it takes time from when the user commands the print execution to the printer until the printing is completed. Particularly, in accordance with the recent increase in the resolution of the image, the number of times the ink is sprayed is increased, which increases the load on the CPU.

SUMMARY OF THE INVENTION

Accordingly, it is an objective of the present invention to provide a liquid spraying method, a liquid spraying system, and a liquid spraying execute program that shorten the processing time required for executing liquid spraying.

To achieve the above objective, the present invention provides a liquid spraying method for spraying liquid from inside a liquid container through a liquid spraying head to a target in accordance with a predetermined spraying procedure. The method includes: determining whether a remaining amount of liquid inside the liquid container is less than or equal to a reference value; executing a monitoring process of liquid only when the remaining amount of liquid inside the liquid container is less than or equal to the reference value; calculating a usage of liquid required for the spraying procedure; and determining whether the calculated usage of liquid is less than or equal to the remaining amount of liquid.

The present invention also provides a liquid spraying system for spraying liquid to a target. The liquid spraying system includes a liquid spraying head, a liquid container, a remaining amount detecting apparatus, a determining apparatus, a usage calculating apparatus, and a comparing apparatus. The liquid spraying head has a nozzle. The liquid container is connected to the liquid spraying head and contains liquid. The liquid container sprays the liquid from the nozzle to the target in accordance with a predetermined spraying procedure. The remaining amount detecting apparatus detects the remaining amount of liquid in the liquid container. The determining apparatus determines whether the remaining amount of liquid is less than or equal to a predetermined reference value. The usage calculating apparatus calculates usage required for the spraying procedure of the liquid when the remaining amount is determined to be less than or equal to the reference value. The comparing apparatus compares the detected remaining amount of the liquid when the remaining amount of liquid is determined to be less than or equal to the reference value with the calculated usage.

A further aspect of the present invention is a program for causing a computer, which controls a liquid spraying apparatus, to function. The liquid spraying apparatus includes a liquid container, which contains liquid, and sprays the liquid to a target in a predetermined spraying procedure. The program includes: detecting the remaining amount of liquid; determining whether the remaining amount of liquid is less than or equal to a predetermined reference value; calculating usage of liquid when the remaining amount is determined to be less than or equal to the reference value, wherein the usage is the amount of liquid required for the spraying procedure; and with respect to the liquid having a detected remaining amount of which is determined to be less than or equal to the reference value, comparing the remaining amount with the calculated usage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A printing system according to a first embodiment of the present invention will now be described with reference to FIGS. 1 to 4.

Figure 1:
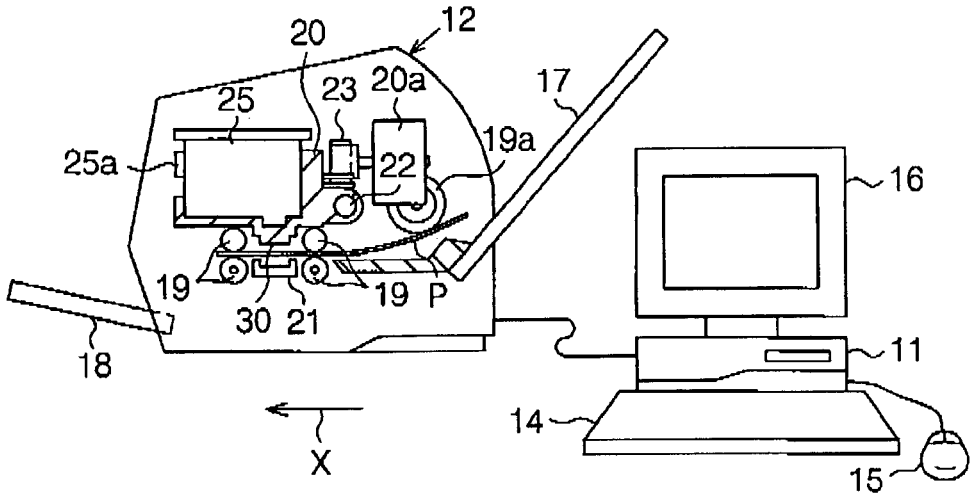
FIG. 1 is a schematic diagram illustrating a printing system according to a first embodiment of the present invention.

As shown in FIG. 1, a liquid spraying system, which is a printing system in the first embodiment, includes a computer 11 and a liquid spraying apparatus, which is an inkjet color printer 12 in the first embodiment. A user connects the computer 11 to the printer 12. The computer 11 is provided with a key board 14 and a mouse 15. Characters are entered and settings are changed in accordance with operations of the key board 14 and the mouse 15. The computer 11 has a monitor 16. The user specifies a document or an image, or commands print execution via the monitor 16.

The printer 12 has a paper feed tray 17 and a paper eject tray 18 located outside the printer 12, and paper feed rollers 19 located inside the printer 12. The paper feed rollers 19 are driven by a paper feed motor 19*a* shown in FIG. 2 as required. The printer 12 draws in a target, which is a sheet of paper P, via the paper feed tray 17 and feeds the sheet of paper P in the sub-scan direction X to eject the sheet of paper P to the paper eject tray 18.

The printer 12 has a carriage 20 and a platen 21, which opposes the carriage 20, inside the printer 12. The platen 21 is a support base, which supports the sheet of paper P during printing. The sheet of paper P fed by the paper feed rollers 19 is guided above the platen 21 during printing. The carriage 20 is fitted to a guide shaft 22 and secured to a timing belt 23, which is driven by a carriage motor 20*a*. The carriage 20 reciprocates in the main scan direction, or the direction perpendicular to the surface of the sheet of FIG. 1.

The carriage 20 is equipped with liquid containers, which are ink cartridges 25 (only one shown in FIG. 1) in the first embodiment. Each ink cartridge 25 contains one of colors of ink such as cyan, light cyan, magenta, light magenta, yellow, dark yellow, and black (corresponds to different kinds of liquid). Each ink cartridge 25 has a remaining amount memory, which is a non-volatile memory (EEPROM) 25*a* in the first embodiment, located on the outer surface of the ink cartridge 25. Each non-volatile memory 25*a* stores ink cartridge information, such as the remaining amount S of ink contained in the ink cartridge 25, the property of ink including the color of the ink, the type of the cartridge, the number of times the ink cartridge is mounted, and the manufacturing date of the ink cartridge.

A liquid spraying head, which is a recording head 30 in the first embodiment, is attached to the lower surface of the carriage 20. The recording head 30 sprays ink droplets onto the sheet of paper P from a nozzle (not shown) by the expansion and contraction of a piezoelectric element 30*a* shown in FIG. 2. The size of each ink droplet is either 11 pl (pico liter), 7 pl, or 4 pl. Thus, the carriage 20 moves in the main scan direction while spraying each color of ink from the corresponding recording head 30 to print on the sheet of paper P.

An electric configuration of the printing system will now be described with reference to FIG. 2.

Figure 2:
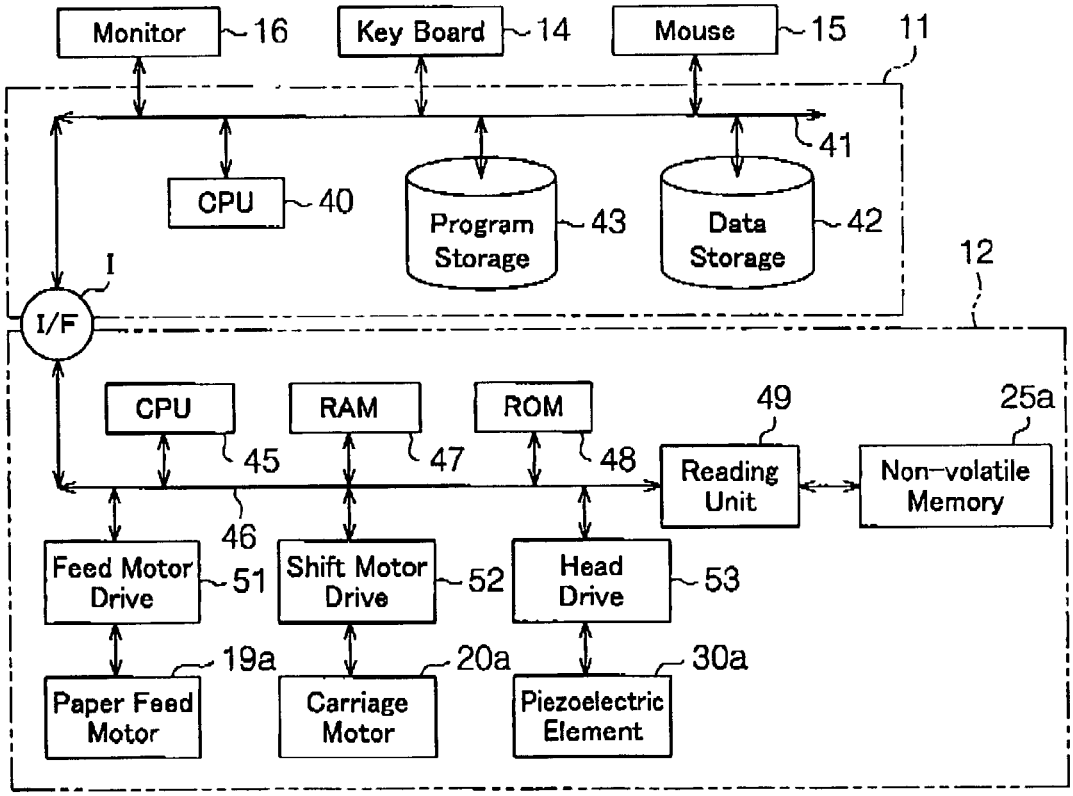
FIG. 2 is a block diagram illustrating an electrical configuration of the printing system shown in FIG. 1.

As shown in FIG. 2, the computer 11 includes a central processing unit (CPU) 40, which serves as a remaining amount detecting apparatus, a determining apparatus, a usage calculating apparatus, a comparing apparatus, a setting apparatus, a changing apparatus, a number of pages calculating apparatus, and a preparing apparatus.

The CPU 40 is connected to the key board 14, the mouse 15, and the monitor 16 via a bus line 41. The CPU 40 is connected to a random access memory (RAM) and a read only memory (ROM), which are not shown. The RAM temporarily stores information, such as values calculated by the CPU 40. The ROM stores the ink usage (calculation reference amount r) for each size of the sheet of paper P on the condition that the full page of the sheet of paper P is printed by one color.

The CPU 40 is connected to a data storage 42 and a program storage 43 via the bus line 41. The data storage 42 stores document data and image data. A printer driver program and a printer application program installed from an information recording medium, which is not shown, are embedded in the program storage 43. The printer driver program converts printing data prepared based on the document data and the image data into intermediate image data (printing data that consists of multi-level signals of cyan, light cyan, magenta, light magenta, yellow, dark yellow, black) that can be processed by the printer 12. The print application program causes the CPU 40 to execute a predetermined operation in response to the user's manipulation to obtain information required for printing and to perform computation. That is, the CPU 40 prepares print data based on the print application program, calculates a monitor judgment amount R, an estimated ink usage T of each ink, and judges whether any of the colors of ink needs to be monitored or whether any of the colors of ink is low by comparing the remaining amount S of each color of ink with the monitor judgment amount R or the corresponding estimated ink usage T. The monitor judgment amount R is the amount of ink used when the entire printing area is printed with one color of ink and is calculated before every printing procedure in accordance with the size of the sheet of paper P and the number of pages to be printed. That is, the monitor judgment amount R is calculated by multiplying the calculation reference amount r by the number of pages to be printed. Thus, the monitor judgment amount R is changed in accordance with the size of the sheet of paper P and the number of pages to be printed. The monitor judgment amount R is the reference amount for judging whether a monitoring process (a process for judging whether any ink runs out during printing) should be performed before actually starting to print.

The estimated ink usage T is the amount of ink calculated from the number of spray and the spraying amount obtained by analyzing the printing data. That is, the estimated ink usage T is the amount of ink required to complete the printing of the printing data.

On the other hand, the printer 12 has a remaining amount calculating apparatus, which is a central processing unit (CPU) 45 in the first embodiment. The CPU 45 is connected to the CPU 40 of the computer 11 via an interface I. The CPU 45 is connected to a RAM 47 and a ROM 48 via a bus line 46. The RAM 47 temporarily stores the printing data received from the computer 11. The ROM 48 stores a predetermined program and performs a predetermined operation based on the program to execute printing.

The CPU 45 of the printer 12 is connected to a feed motor drive 51, a shift motor drive 52, and a head drive 53 via the bus line 46. The feed motor drive 51 drives the paper feed motor 19*a*, the shift motor drive 52 drives the carriage motor 20*a*, and the head drive 53 drives the piezoelectric element 30*a*.

The CPU 45 of the printer 12 is connected to a reading unit 49. The reading unit 49 is selectively connected to the non-volatile memory 25*a* when the carriage 20 is located at a non-operating position (standby position). That is, the CPU 45 reads from and writes to the non-volatile memory 25*a* via the reading unit 49 when the carriage 20 is at the non-operating position.

The operations of the printing system will now be described with reference to FIGS. 3 and 4.

The user activates the print application program using the key board 14 or the mouse 15 to print a document or an image displayed on the monitor 16 of the computer 11. After activating the program, the user specifies the size of the sheet of paper P and the number of pages to be printed (for example, the size of the sheet of paper P is A4 and number of pages is ten) using the key board 14 or the mouse 15 and enters a print execution command. At this time, the data of the document or image to be printed is saved in the data storage 42. When the print execution command is entered in step S11 of FIG. 3, the computer 11 obtains the data of the specified document or image from the data storage 42 in step S11A and prepares the printing data based on the data.

In step S12, the computer 11 calculates the monitor judgment amount R from the size of the sheet of paper P and the number of pages that are specified at the same time as the print execution command is entered. More specifically, the CPU 40 reads the calculation reference amount r corresponding to the sheet of paper P having the specified size (for example, A4). The CPU 40 then calculates the monitor judgment amount R by multiplying the calculation reference amount r that is read from the ROM by the number of pages to be printed. That is, the CPU 40 calculates the monitor judgment amount R as the amount of ink required when the specified number of pages of the sheet of paper P having the specified size is printed in full page with a single color. In the first embodiment, the monitor judgment amount R is calculated for each color of ink.

In step S13, the computer 11 sends a remaining amount acquisition signal to the CPU 45 of the printer 12 in order to acquire data regarding the remaining amount S of ink from the non-volatile memory 25*a* of each ink cartridge 25. In step S14, the CPU 45 of the printer 12 that has received the signal reads the ink information from the non-volatile memory 25*a* of each ink cartridge 25 via the reading unit 49. The CPU 45 then transmits only the data regarding the remaining amount S of the ink of each ink cartridge 25 to the CPU 40 of the computer 11.

In step S15, the CPU 40 of the computer 11 judges whether the remaining amount S of each color of ink transmitted from the CPU 45 of the printer 12 in step S14 is less than or equal to the monitor judgment amount R. That is, the CPU 40 of the computer 11 judges whether the monitoring process needs to be executed.

If the decision outcome of step S15 is negative, that is, when it is determined that the remaining amount S of each color of ink is greater than the monitor judgment amount. R, or is not less than or equal to the monitor judgment amount R, the computer 11 proceeds to step S16 shown in FIG. 4. In step S16, the computer 11 converts the printing data to intermediate image data in accordance with the printer driver program.

In step S17, the computer 11 calculates the time required for printing based on the size of the sheet of paper P and the number of pages to be printed. The time required for printing is obtained by multiplying the average printing time corresponding to the sheet of paper P by the number of pages to be printed. In step S18, the computer 11 displays the calculated result of the time required for printing on the monitor 16. In step S19, the computer 11 transmits the converted intermediate image data to the printer 12.

In step S20, the printer 12 prints based on the intermediate image data. More specifically, the CPU 45 of the printer 12 temporarily stores the received intermediate data in the RAM 47. Then, the CPU 45 sends a drive signal to each of the feed motor drive 51, the shift motor drive 52, and the head drive 53 based on the temporarily stored data and the program stored in the ROM 48. This causes the carriage 20 to shift while spraying ink droplets having a predetermined size from the nozzle (not shown) of the recording head 30. The feed motor drive 51 is operated every time the recording head 30 is shifted in the main scan direction so that the sheet of paper P is fed during printing. The RAM 47 of the printer 12 stores the number of times the ink in each ink cartridge 25 is sprayed from the corresponding nozzle and the spraying amount E that is actually sprayed each time the ink is sprayed.

When printing is completed, in step S21, the CPU 45 of the printer 12 calculates the remaining amount SL of each ink by subtracting the actual ink usage (sum of the spraying amount E) W actually used during the latest printing that is stored in the RAM 47 from the remaining amount S at the start of the printing. In step S22, the CPU 45 causes the non-volatile memory 25*a* of each ink cartridge 25 to store the remaining amount SL of ink as the new remaining amount S via the reading unit 49. In step S23, the printer 12 transmits a print complete signal to the computer 11. In step S24, the computer 11 displays that the printing is completed on the monitor 16.

Figure 3:
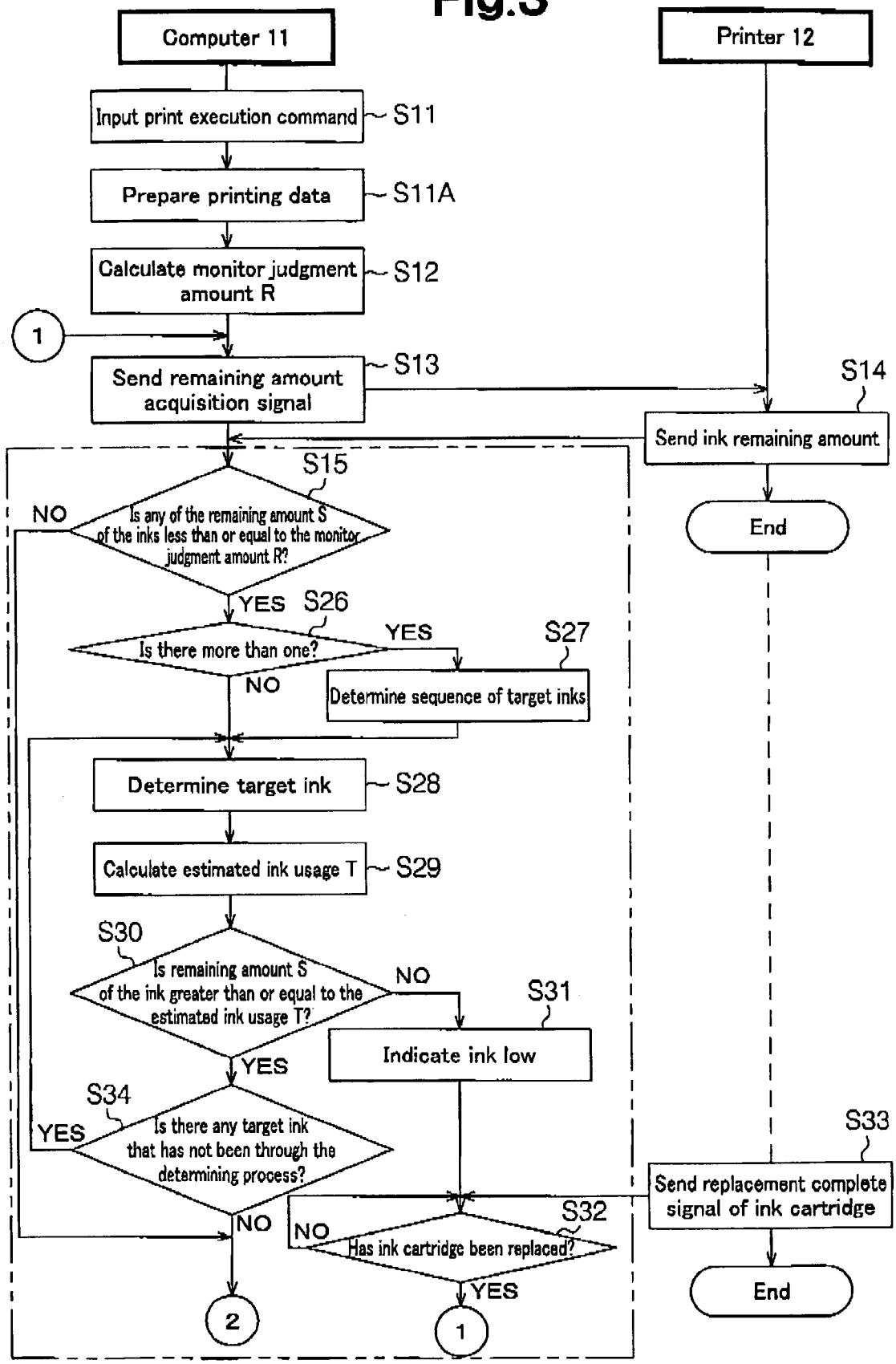
FIG. 3 is a flowchart illustrating the first stages of a printing routine according to the first embodiment.

On the other hand, as shown in FIG. 3, if the decision outcome of step S15 is positive, that is, if it is determined that there is at least one ink cartridge 25 that has a remaining amount S of ink that is less than or equal to the monitor judgment amount R, the computer 11 proceeds to step S26. In step S26, the computer 11 determines whether there is more than one ink cartridge 25 that has a remaining amount S of ink that is less than or equal to the monitor judgment amount R. If the decision outcome of step S26 is positive, that is, if it is determined that there is more than one ink cartridge 25 that has a remaining amount S of ink that is less than the monitor judgment amount R, the computer 11 proceeds to step S27. In step S27, the computer 11 determines the sequence of the target inks. The target inks refer to the inks that will become the target of the process to be performed hereafter. The sequence of the target inks is the sequence of the inks to become the target ink when the process is repeatedly performed. The sequence is determined in order from the ink that has smallest remaining amount S to the ink that has largest remaining amount S. For example, the ink cartridges 25 that have the ink the remaining amount S of which is less than or equal to the monitor judgment amount R are each assumed to contain cyan ink, magenta ink, or yellow ink. In the case the remaining amount S increases in the order from the cyan ink to the yellow ink to the magenta ink, the computer 11 determines that the cyan ink is the first, the yellow ink is the second, and the magenta ink is the third to become the target ink.

In step S28, the computer 11 determines the target ink for executing the monitoring process. When the monitoring process is to be executed on more than one ink, the computer 11 determines the target ink in the sequence determined in step S27. That is, in this case, the cyan ink the sequence of which is the first is selected as the target ink. If the decision outcome in step S26 is negative, that is, if there is only one ink cartridge 25 that has the ink the remaining amount S of which is less than or equal to the monitor judgment amount R, the ink contained in the ink cartridge 25 is determined to be the target ink in step S28.

In step S29, the computer 11 analyzes the printing data regarding the determined target ink of the ink cartridge 25, and calculates the estimated ink usage T of the ink. More specifically, the CPU 40 of the computer 11 first analyzes the printing data to obtain the number of sprays of the target ink and the spraying amount per one spray. Then, the CPU 40 calculates the estimated ink usage T of the target ink required for printing from the obtained number of sprays and the spraying amount.

In step S30, the computer 11 compares the estimated ink usage T with the current remaining amount S of the target ink to determine whether the remaining amount S is greater than or equal to the estimated ink usage T. If the decision outcome of step S30 is negative, that is, if it is determined that the remaining amount S of the target ink is not greater than or equal to the estimated ink usage T, the computer 11 determines that the target ink will run out during printing and proceeds to step S31. In step S31, the computer 11 indicates on the monitor 16 that the color of the target ink has a low ink level. At this time, the monitor 16 indicates that the ink cartridge 25 containing the color of ink that is low should be replaced.

The user replaces the ink cartridge 25 of the target ink that the user is prompted to replace with another ink cartridge 25 containing the same color of ink and having more than remaining amount S of ink when the replacement is completed, the printer 12 transmits a replacement complete signal of the ink cartridge 25 to the computer 11 in step S33. Upon reception of the signal, in step S32, the computer 11 determines that the ink cartridge 25 has been replaced, that is, the decision outcome of step S32 is positive, and proceeds to step S13. In step S13, the computer 11 reads the data of the remaining amount S of the ink contained in the replaced ink cartridge 25, and repeats the processes after step S13.

On the other hand, if the decision outcome of step S30 is positive, that is, if it is determined that the remaining amount S is greater than or equal to the estimated ink usage T, the computer 11 proceeds to step S34. In step S34, the computer 11 determines whether there is any target ink that has not gone through the monitoring process. If there is only one ink cartridge 25 that has the ink the remaining amount S of which is less than or equal to the monitor judgment amount R, that is, if the decision outcome of step S26 is negative, there is no more target ink that has not gone through the monitoring process. In this case, the computer 11 executes processes of step S16 to step S24 shown in FIG. 4 and completes printing.

On the other hand, as shown in FIG. 3, if the decision outcome of step S34 is positive, that is, if it is determined that there is the target ink that has not gone through the monitoring process, the computer 11 repeats the monitoring process described in steps S28 to S34 on the target ink that has not gone through the monitoring process. More specifically, the computer 11 executes the monitoring process on the yellow ink the sequence of which is determined to be the second, and then on the magenta ink the sequence of which is determined to be the third. The computer 11 repeats the monitoring process on the target inks in the order from the ink the remaining amount S of which is smallest until there is no more target ink.

Figure 4:
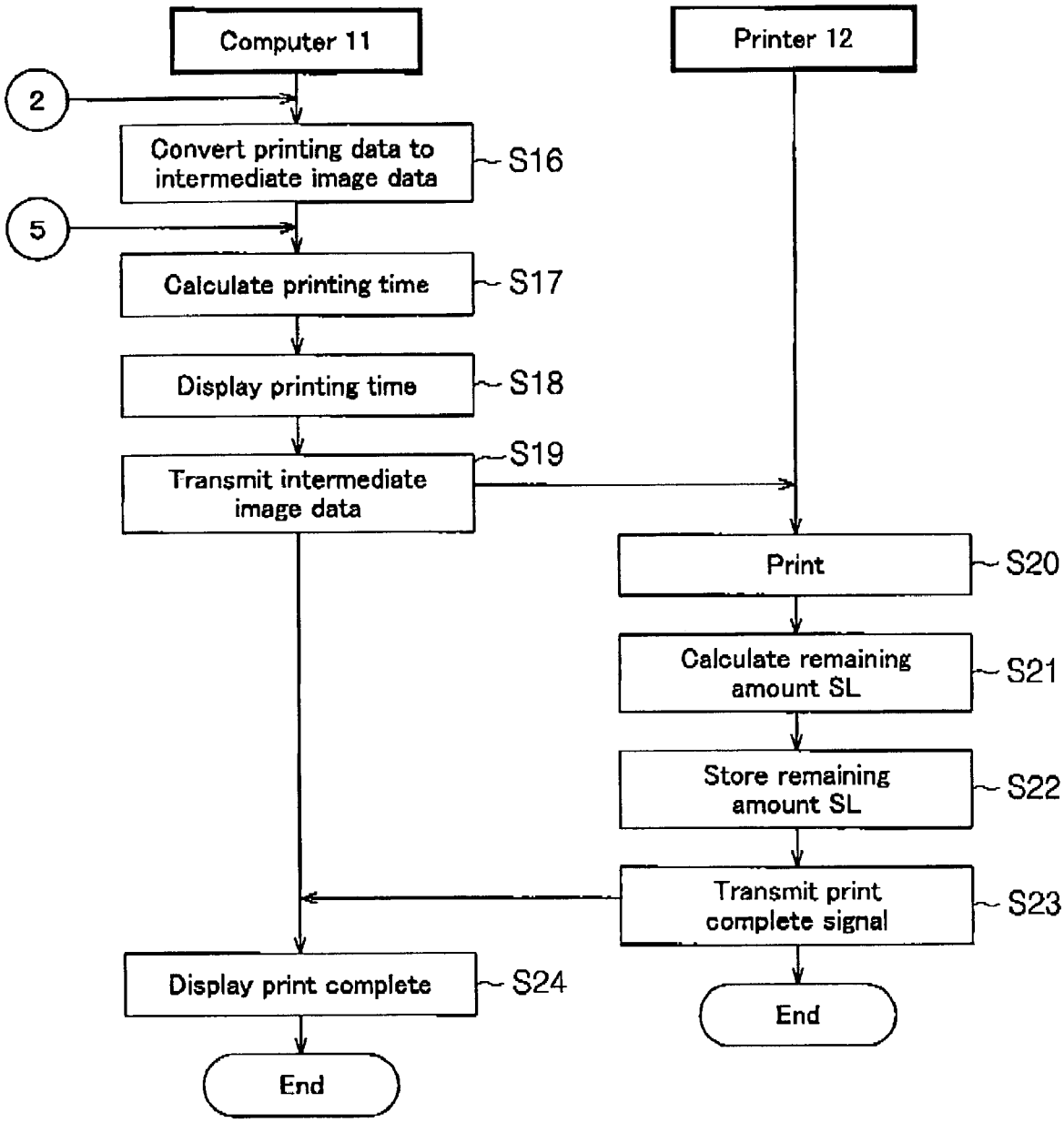
FIG. 4 is a flowchart illustrating the later stages of the printing routine of FIG. 3.

When the decision outcome of step S15 is positive, that is, there is at least one ink cartridge 25 that has the ink the remaining amount S of which is less than or equal to the monitor judgment amount R, and all the decision outcomes of step S34 are negative, that is, the remaining amount S of all colors of ink are greater than or equal to the estimated ink usage T, the computer 11 executes the processes of steps S16 to S24 shown in FIG. 4 and completes printing.

The printing system of the first embodiment provides the following advantages.

The computer 11 monitors whether the remaining amount S is greater than or equal to the estimated ink usage T required for printing, that is, whether printing can be completed without running out of ink during printing in step S30 only when the decision outcome of step S15 is positive. That is, the computer 11 monitors whether the remaining amount S is greater than or equal to the estimated ink usage T required for printing only when the remaining amount S of any colors of ink in the ink cartridge 25 is less than or equal to the monitor judgment amount R. More specifically, if it is determined that the remaining amount S is greater than or equal to the monitor judgment amount R and any colors of ink obviously will not run out during printing, the CPU 40 of the computer 11 executes printing without calculating the estimated ink usage T of the ink. Therefore, the CPU 40 of the computer 11 does not calculate the estimated ink usage T of all the inks every time the printing is performed. This reduces the load on the CPU 40 of the computer 11 and shortens the time take from the start of printing to the end of printing.

If the decision outcome of step S26 is positive, that is, there is more than one color of ink that has a remaining amount S of ink that is less than or equal to the monitor judgment amount R, the computer 11 determines the sequence of the colors of ink in order from the color of ink having the smallest remaining amount S in step S27. The computer 11 then determines whether the remaining amount S of the ink is greater than or equal to the estimated ink usage T in the sequence determined in step S30 (monitoring process). That is, if the estimated ink usage is the same, the computer 11 executes the monitoring process from the ink that is more likely to run out. Accordingly, the computer 11 promptly detects the ink that might run out and informs the user of the ink shortage.

In step S12, the computer 11 calculates the monitor judgment amount R of each color of ink from the size of the sheet of paper P and the number of pages to be printed, which are entered with the print execution command. Therefore, the computer 11 easily and accurately calculates the monitor judgment amount R as an approximate value that the ink will not run out before starting to print. Thus, the computer 11 more accurately and easily determines in a short time whether any ink will run out.

In step S17, the computer 11 calculates the time required for printing before the printer 12 starts to print and displays the time required for printing on the monitor 16 in step S18. Therefore, the user is informed of the time when the printing will be completed. Thus, the user can be away from the printer 12 doing other work during printing, and then come back to the printer 12 when the printing is completed to have the printer 12 execute the next printing. Thus, the user can effectively use the time required for printing.

After completing the printing, the printer 12 calculates the remaining amount S of each color of ink in step S21. In step S22, the printer 12 stores the remaining amount S of each color of ink in the corresponding non-volatile memory 25*a*. Therefore, the computer 11 promptly obtains the remaining amount S of each color of ink from the printer 12. This further reduces the time required from when the user enters the print execution command until the printing is completed.

After the ink cartridge 25 is determined to have a low ink level and is replaced, the computer 11 compares the remaining amount S of the replaced ink cartridge 25 with the monitor judgment amount R. Therefore, the ink cartridge that was used before can be used as a replacement. In this case, if the remaining amount S of the ink of the replaced ink cartridge 25 is greater than or equal to the monitor judgment amount R, it is determined that the ink will not run out and the printing is promptly performed to the end.

A second embodiment of the present invention will now be described with reference to FIG. 5. Like or the same reference numerals are given to those components that are like or the same as the corresponding components of the first embodiment of FIGS. 1 to 4 and detailed explanations are omitted. The second embodiment differs from the first embodiment of FIGS. 1 to 4 in that the monitoring process corresponding to a portion surrounded by a chain double-dashed line in FIG. 3 is replaced with the routine shown in FIG. 5. In the second embodiment, the monitoring process is executed only on one color of ink although there is more than one ink the remaining amount S of which is less than or equal to the monitor judgment amount R.

Figure 5:
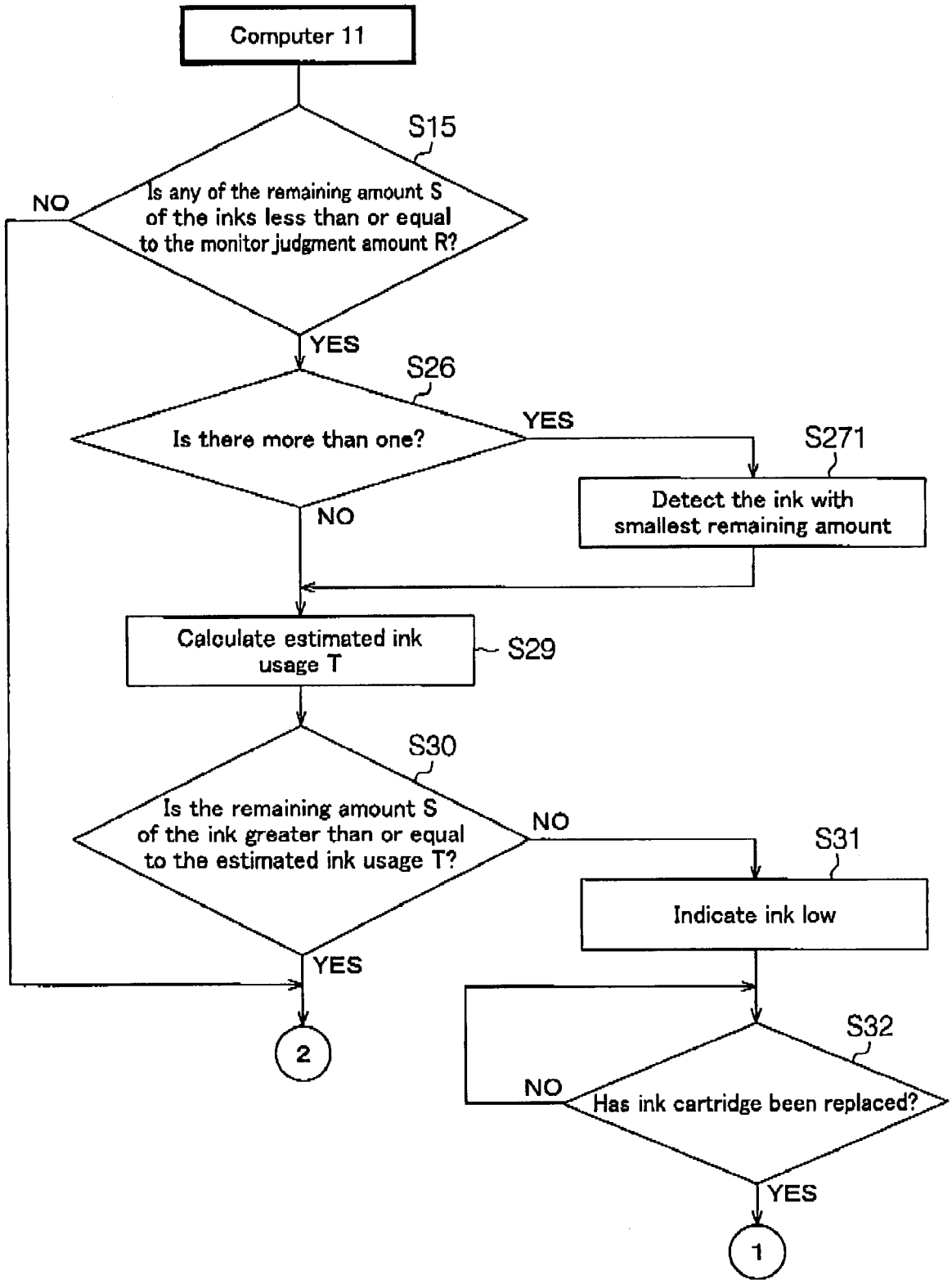
FIG. 5 is a flowchart illustrating the main part of a printing routine according to a second embodiment of the present invention.

As shown in FIG. 5, the computer 11 determines whether the remaining amount S of each color of ink read from the corresponding non-volatile memory 25*a* is less than or equal to the monitor judgment amount R in step S15, in the same S manner as step S15 of FIG. 3. If the decision outcome of step S15 is positive, the computer 11 proceeds to step S26. In step S26, the computer 11 determines whether there is more than one ink cartridge 25 that has a remaining amount S of ink that is less than or equal to the monitor judgment amount R. If the decision outcome of step S26 is positive, that is, if it is determined that there is more than one ink cartridge 25 that has a remaining amount S of ink that is less than the monitor judgment amount R, the computer 11 proceeds to step S271. In step S271, the computer 11 compares the remaining amount S of each color of ink and detects the ink that has the smallest remaining amount S.

In step S29, the computer 11 calculates the estimated ink usage T from the printing data regarding the color of ink that is determined to have the least remaining amount S in step S271. In step S26, if it is determined that there is only one ink cartridge 25 that has a remaining amount S of ink that is less than or equal to the monitor judgment amount R, the computer 11 calculates the estimated ink usage T from the printing data regarding the ink of the ink cartridge 25 in step S29. The computer 11 then proceeds to step S30. In step S30, the computer 11 determines whether the remaining amount S is greater than or equal to the estimated ink usage T.

If the decision outcome of step S30 is negative, that is, if it is determined that the remaining amount S is not greater than or equal to the estimated ink usage T, or if it is determined that the ink will run out during printing, the computer 11 indicates the ink low message on the monitor 16 in step S31 and executes the processes after step S31.

On the other hand, if the decision outcome of step S30 is positive, that is, if it is determined that the remaining amount S of the ink is greater than or equal to the estimated ink usage T, the computer 11 executes the processes of steps S16 to S24 and completes the printing.

The second embodiment provides the following advantages in addition to the advantages of the first embodiment of FIGS. 1 to 4.

If the decision outcome of step S26 is positive, that is, if there is more than one ink cartridge 25 containing a remaining amount S of ink that is less than or equal to the monitor judgment amount R, the computer 11 calculates only the estimated ink usage T of the ink that has the smallest remaining amount S and is most likely to run out. Therefore, the calculation of the estimated ink usage T is minimized, which reduces the load on the computer 11 and shortens the printing time.

A third embodiment of the present invention will now be described with reference to FIGS. 6 to 9. Like or the same reference numerals are given to those components that are like or the same as the corresponding components of the first embodiment of FIGS. 1 to 4 and detailed explanations are omitted.

Figure 6:
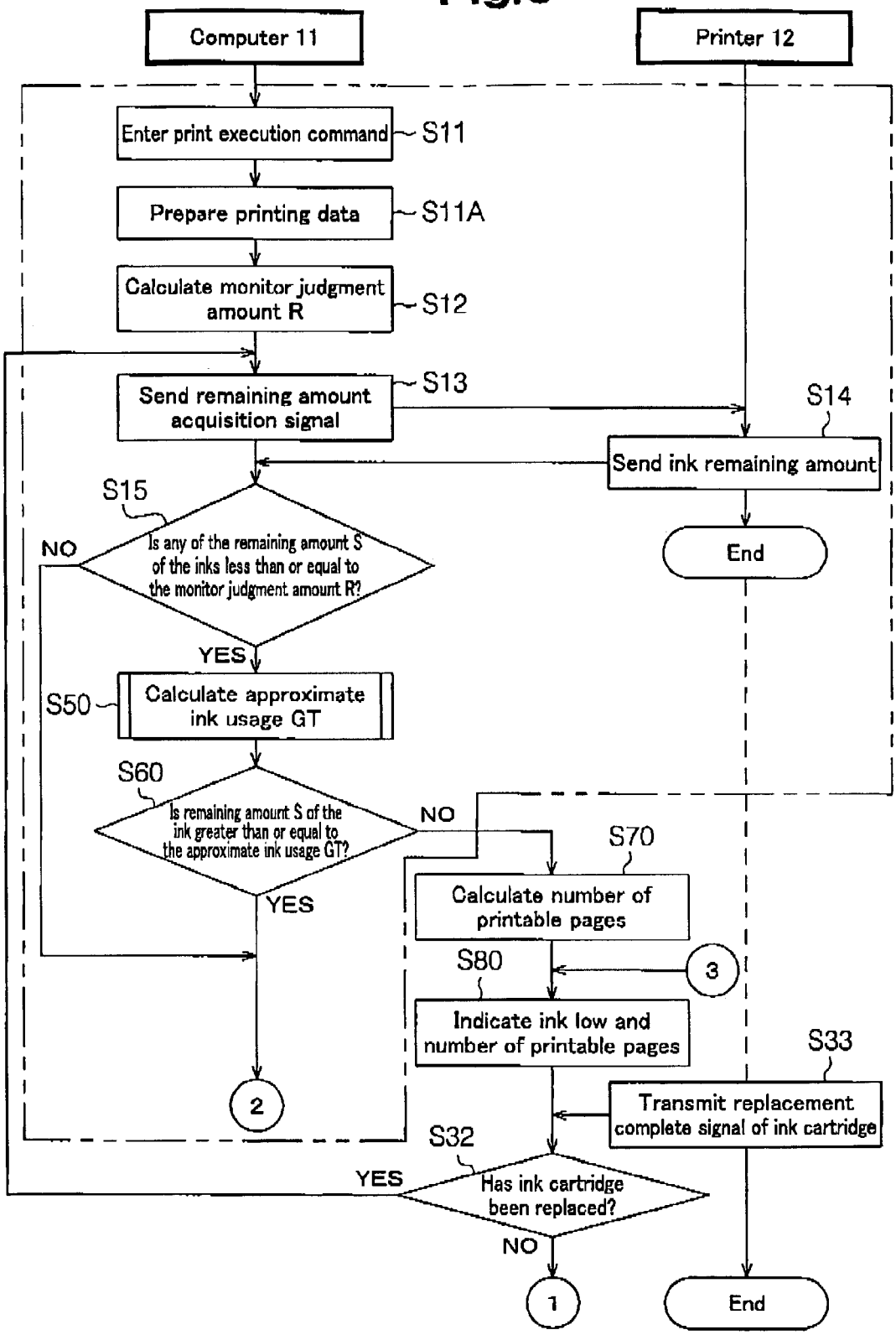
FIG. 6 is a flowchart illustrating the first stages of a printing routine according to a third embodiment of the present invention.

The operation of a printing system according to the third embodiment will be described with reference to FIGS. 6 to 8. Steps S11 to S15 of FIG. 6 are the same as steps S11 to S15, 32, and 33 of the first embodiment of FIG. 3.

If the decision outcome of step S15 is positive, that is, if the remaining amount S of the ink is less than or equal to the monitor judgment amount R, the computer 11 proceeds to step S50. In step S50, the computer 11 calculates the approximate ink usage GT of the ink cartridge 25. More specifically, as shown in FIG. 7, in step S501, the computer 11 extracts data of one line per four lines of the printing data (or every fourth line).

The approximate ink usage GT is the reference amount, which is used for determining ink shortage (liquid shortage). The approximate ink usage GT is calculated as a value that is substantially equal to the actual ink usage by multiplying the calculation reference amount, which is a data analysis amount SR, by four. The data analysis amount SR is the sum of the estimated ink usage of each color of ink to be used in the data extracted from the printing data. That is, the data analysis amount SR is the estimated ink usage of each ink obtained by analyzing the quarter portion of the printing data. Therefore, the approximate ink usage GT is calculated by multiplying the data analysis amount SR by four.

The data of one line is the number of sprays and the spraying amount from each nozzle while the recording head 30 is shifted one time from one end to the other end in the main scan direction to print on the sheet of paper P. The data is actually extracted from the fourth line, the eighth line, the twelfth line, and the four times m (m is an integer number) line.

In step S502, the computer 11 obtains the data analysis amount SR for each color of ink by adding the product of the number of sprays and the spraying amount for each line (the fourth line, the eighth line, the twelfth line, and four times m line). That is, the computer 11 calculates the data analysis amount SR, which is the sum of the estimated ink usage in the quarter portion of the printing data, for each ink. In step S503, the computer 11 calculates the approximate ink usage GT of each color of ink by multiplying the data analysis amount SR by four.

Then, in step S60 of FIG. 6, the computer 11 compares the remaining amount S obtained in step S13 with the approximate ink usage GT calculated in step S50 for all inks that have a remaining amount S that is determined to be less than or equal to the monitor judgment amount R. The computer 11 determines whether there is any ink cartridge 25 that contains a remaining amount S of ink that is less than the approximate ink usage GT. If the decision outcome of step S60 is positive, that is, if there is no ink cartridge 25 that contains a remaining amount S of ink that is less than the approximate ink usage GT, the computer 11 proceeds to step S16 of FIG. 4. In other words, if the computer 11 determines that the remaining amount S of all the colors of ink are greater than or equal to the approximate ink usage GT, the computer 11 proceeds to step S16 of FIG. 4. Then, the processes of steps S16 to 524 are executed to complete the printing.

On the other hand, if the decision outcome of step S60 is negative, that is, if there is any ink cartridge 25 that has a remaining amount S of ink that is less than the approximate ink usage GT, the computer 11 proceeds to step S70. In step S70, the computer 11 calculates how many pages can be printed with the current remaining amount S of the ink on the sheet of paper P having the specified size (for example, size A4). In other words, the computer 11 calculates the number of targets to which liquid can be sprayed. The number of pages is calculated by dividing the remaining amount S of the ink by the calculation reference amount r stored in the ROM. If there is more than one ink cartridge 25 that contains a remaining amount S of that is less than the approximate ink usage GT, the number of pages that can be printed is calculated based on the color of ink that has the smallest remaining amount S. That is, the number of pages that can be printed is calculated by dividing the remaining amount S of the ink (the remaining amount of the ink having the smallest remaining amount S, if there is more than one) by the calculation reference amount r.

Figure 9:
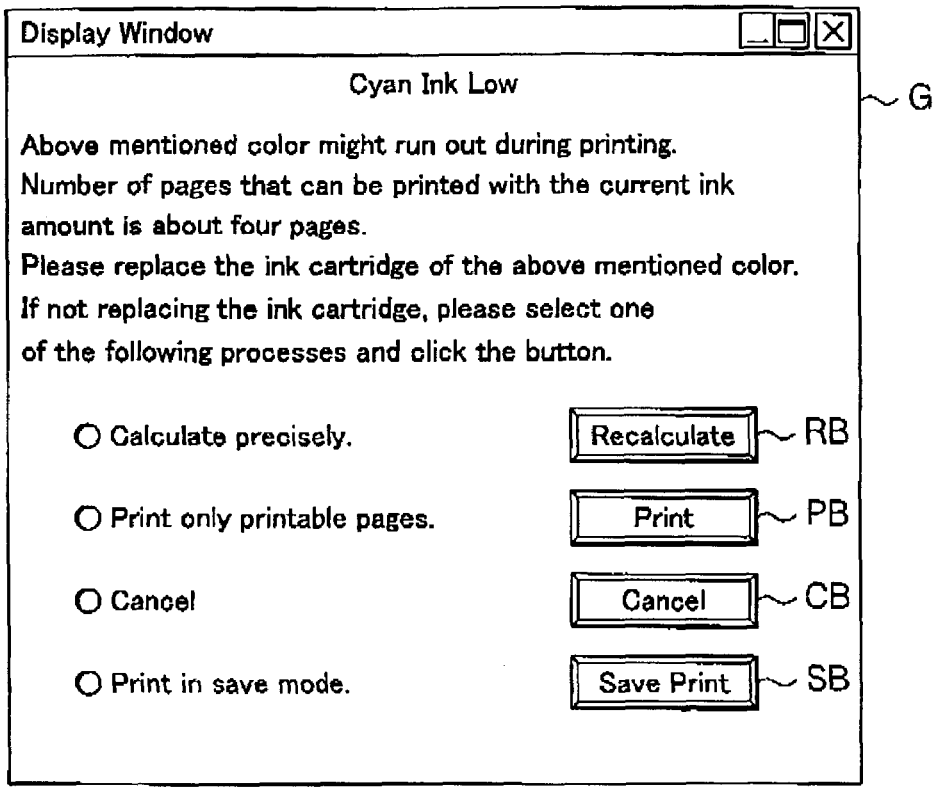
FIG. 9 is an explanatory diagram of a display window according to the third embodiment indicating an ink low message.

In step S80, the computer 11 indicates, as shown in FIG. 9, that the ink is low, the color of the ink cartridge 25 that contains the ink that is determined to be low (for example, cyan), and the number of pages that can be printed with that ink (for example, four pages) on a display window G, which is the monitor 16. The display window G displays a cancel button CB, a recalculation button RB, a print button PB, and a save print button SB. The cancel button CB is used to cancel execution of printing commanded in step S11 to, for example, change the setting for the number of pages to be printed. The recalculation button RB is used to recalculate for determining whether the ink is really insufficient by calculating the spray amount and the number of spraying based on the printing data that will actually be printed. The print button PB is used to print the number of pages that can be printed with the current ink amount. The save print button SB is used to save the spraying amount of ink that is determined to be low to complete the entire printing job.

Assume that, for example, the user has replaced the ink cartridge 25 that contains the color of ink (for example, cyan) that is indicated to be low with the ink cartridge 25 that contains the same color and has greater remaining amount S in response to the indication of the ink low massage on the display window G. When the ink cartridge 25 is replaced, the printer 12 transmits a replacement complete signal indicating that the ink cartridge 25 has been replaced in step S33 of FIG. 6. If it is determined that the ink cartridge 25 has been replaced in step S32, the computer 11 returns to step S13.

Figure 8:
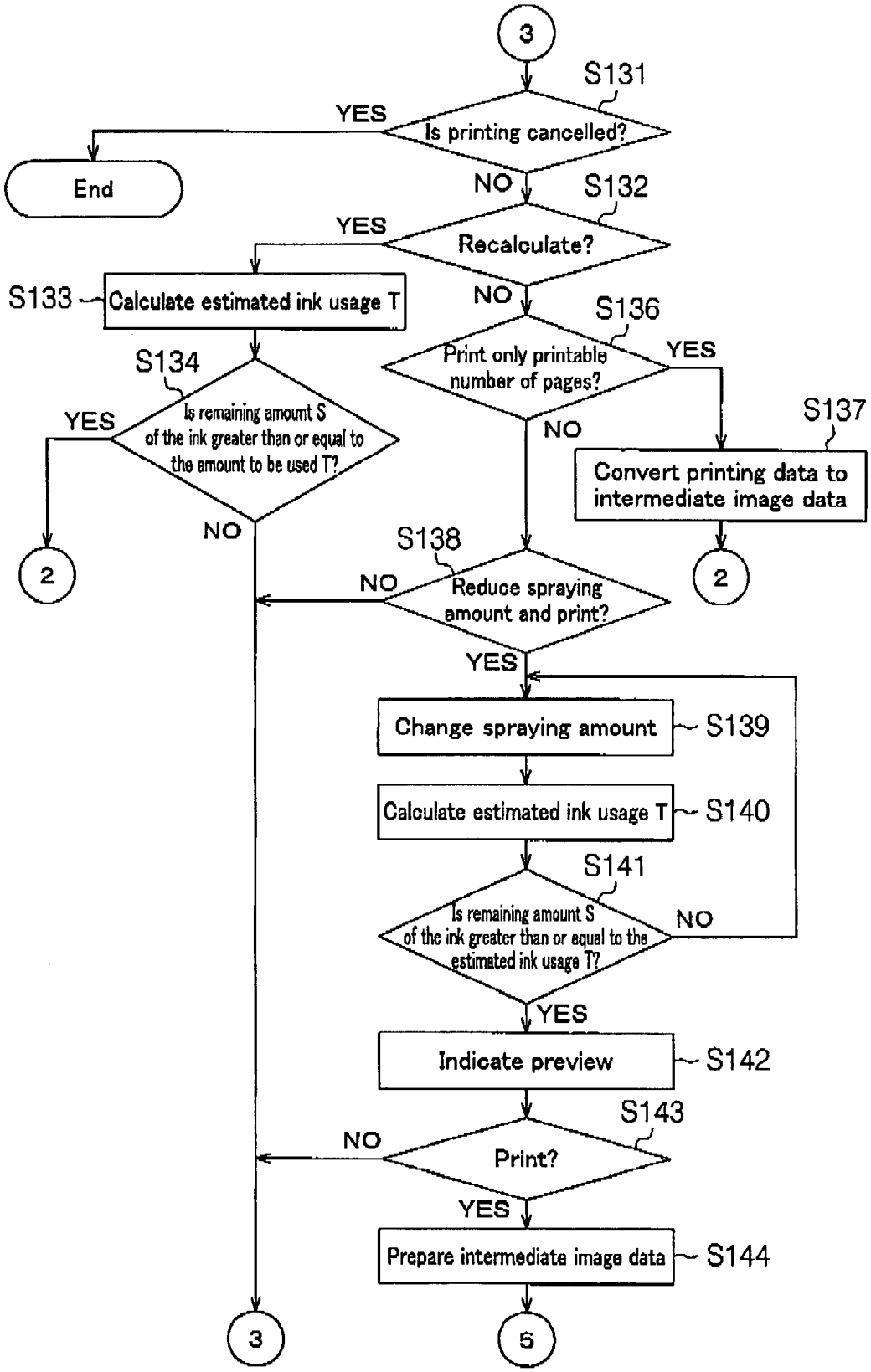
FIG. 8 is a flowchart illustrating the later stages of the printing routine of FIG. 6.

On the other hand, if it is determined that the ink cartridge 25 has not been replaced in step S32, the computer 11 proceeds to step S131 in FIG. 8. In steps S131, S132, S136, and S138, the computer 11 determines which of the cancel button CB, the recalculation button RB, the print button PB, and the save print button SB is selected.

For example, if the decision outcome of step S131 is positive, that is, if the user selects the cancel button CB, the computer 11 determines that the printing is cancelled and terminates the routine.

If the decision outcome of step S132 is positive, that is, if the user selects the recalculation button RB, the computer 11 proceeds to step S133. In step S133, the computer 11 analyzes all the printing data prepared in step S11 and accurately calculates the estimated ink usage T. Step S133 is the same as step S29 of FIG. 3. Then, in step S134, the computer 11 determines whether the remaining amount S of the ink that is indicated to have a low ink level on the display window G is greater than or equal to the estimated ink usage T that has been recalculated. If the decision outcome of step S134 is positive, the computer 11 proceeds to step S16 of FIG. 4 and executes the processes of steps S16 to S24. If the decision outcome of step S34 is negative, the computer 11 returns to step S80 of FIG. 6.

If the decision outcome of step S136 of FIG. 8 is positive, that is, if the user selects the print button PB, the computer 11 proceeds to step S16 of FIG. 4. In this case, the computer 11 converts the printing data of the number of pages that can be printed (in this case, four pages from page 1 to page 4) into the intermediate image data and proceeds to step S17 shown in FIG. 4. Then, steps S17 to S24 are executed and the printing is completed.

In step S138 of FIG. 8, if the user selects the save print button SB, the computer 11 determines that the save print process is selected and proceeds to step S139. In step S139, the computer 11 determines how much spraying amount will be decreased and changes the setting to that spraying amount. For example, the droplet sizes are generally set to 11 pl, 7 pl, and 4 pl as the spraying amount E1, when there is sufficient amount of ink. When the save print process is selected, the droplet sizes are changed to 7 pl, 4 pl, and 0 pl, which will be referred to as the spraying amount E2.

In step S140, the computer 11 calculates the estimated ink usage T of the ink that has a remaining amount S determined to be less than the approximate ink usage GT when the spraying amount E1 is changed to the spraying amount E2. In step S141, the computer 11 determines whether the remaining amount S of the ink is greater than or equal to the estimated ink usage T. If the decision outcome of step S141 is negative, that is, if the remaining amount S is less than the estimated ink usage T, the computer 11 returns to step S139 and changes the droplet sizes that are set to 7 pl and 4 pl as the spraying amount E2 to 4 pl and 0 pl. The computer 11 then repeats steps S140 and S141. That is, the computer 11 repeats steps S139 to S141 until the remaining amount S becomes greater than or equal to the estimated ink usage T.

If the decision outcome of step S141 is positive, that is, if it is determined that the remaining amount S of the ink is greater than or equal to the estimated ink usage T, the computer 11 proceeds to step S142. In step S142, the computer 11 prepares data for a preview based on the spraying amount E2 and displays the preview. An image that has reduced color components of cyan that is assumed to be insufficient is displayed in the preview. In other words, an entire image formed by spraying small amount of ink is displayed. The preview includes a print button and a cancel button together with the image. If the decision outcome of step S143 is negative, that is, if it is determined that the user selected the cancel button, the computer 11 determines not to execute printing and proceeds to step S28 of FIG. 6 to show the display window G shown in FIG. 9 again. This process corresponds to step S28 of FIG. 6 and the subsequent processes are executed.

On the other hand, if the decision outcome of step S143 is positive, that is, if it is determined that the user selected the print button, the computer 11 proceeds to step S144. In step S144, the computer 11 prepares the intermediate image data based on the printing data used to display the preview, that is, the printing data in which the spraying amount of the ink having insufficient remaining amount S has been reduced. The computer 11 then executes processes of step S17 to S24 of FIG. 4 and completes printing.

The printing system of the third embodiment provides the following advantages.

Figure 7:
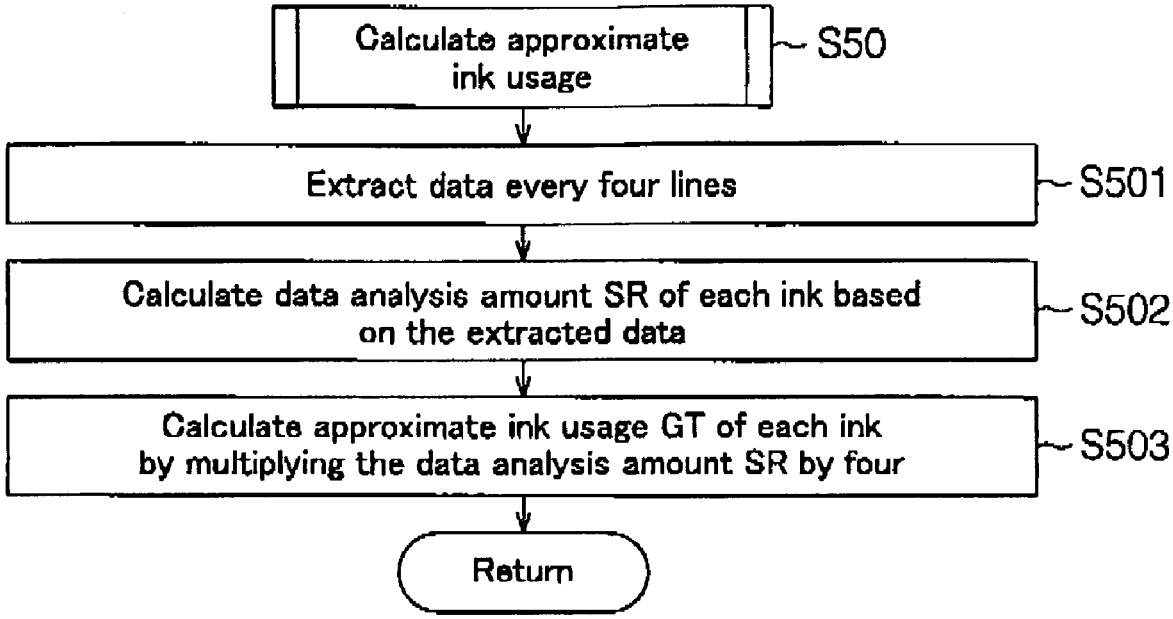
FIG. 7 is a flowchart illustrating a calculation routine of an approximate ink usage shown in the flowchart of FIG. 6.

As shown in step S503 of FIG. 7, the approximate ink usage GT of each color of ink is calculated based on data extracted every four line from the printing data. The computer 11 determines whether each ink runs out based on the comparison between the approximate ink usage GT and the remaining amount S (see step S50). Therefore, the computer 11 determines whether the ink will run out in accordance with the approximate ink usage GT calculated based on the fourth part of the printing data instead of the estimated ink usage T obtained by analyzing the entire printing data (entire liquid spraying data). This reduces the amount of analysis of the printing data that applies great load on the computer 11. This also reduces the time required from when the print execution is commanded till the completion of the printing (steps S11 to S24 in FIGS. 4 and 6). Further, since the approximate ink usage GT is based on part of the printing data that is actually printed by the printer 12, the approximate ink usage GT is substantially the same as the estimated ink usage T used by the actual printing. That is, the computer 11 more accurately judges the ink shortage while reducing the load on the printer 12, and shortens the printing time, which is the processing time of the liquid spraying.

The approximate ink usage GT is obtained by analyzing the data extracted every four lines from the printing data and multiplying the obtained data analysis amount SR by four. That is, since the fourth part of the printing data is extracted from the printing data evenly and the obtained data analysis amount SR is multiplied by four, the ink usage that is closer to the actual ink usage during actual printing is obtained. Also, since the approximate ink usage GT is obtained by simply multiplying the data analysis amount SR, which is calculated based on the fourth part of the printing data, by four, the load applied to the computer 11 for analyzing the printing data to calculate the approximate ink usage GT is reduced to fourth part.

If there is any ink cartridge 25 that contains a remaining amount S of ink that is less than the approximate ink usage GT, the computer 11 calculates the number of pages that can be printed with the ink having the remaining amount S (see step S70 of FIG. 6). The computer 11 then displays that the ink level is low and the number of printable pages, for example, four pages (step S80 of FIG. 6). Therefore, the user can print the printable pages (page one to page four) without replacing the ink cartridge 25 that contains the ink that will run out. Since the user is informed of how may pages that can be printed with the current level of ink, the user may reduce the number of pages to be printed to four pages, reduce the size of the sheet of paper P and print more pages, or select the part to be printed.

When the user selects the save print button SB, the computer 11 changes the spraying amount E1 of the ink cartridge 25 that has a remaining amount S of ink that is less than the approximate ink usage GT to the spraying amount E2 that allows more pages to be printed (step S139 to S141 of FIG. 8). Therefore, the spraying amount of each ink is reduced and more pages can be printed.

The ink droplets that are sprayed in the sizes of 11 pl, 7 p1, and 4 pl when there is sufficient ink are sprayed in 7 pl, 4 pl, and 0 pl when there is insufficient ink. That is, the largest droplet 11 pl is changed to 7 pl, the second largest droplet 7 pl is changed to 4 pl. Therefore, the color of ink that is determined to be insufficient is evenly reduced. This prevents the color from being reduced at only a portion of the image to be printed. That is, the image is printed in a state close to a print out provided when there is sufficient ink.

The printing image to be printed by the spraying amount E2 is displayed as a preview (see step S142 of FIG. 8). Therefore, the user obtains the image of the actual output in advance. Thus, if the printing image greatly differs from the printing image when the ink is sufficient, the user may cancel the printing. Therefore, less sheet of paper P and the ink are wasted.

The computer 11 monitors whether the remaining amount S is greater than or equal to the approximate ink usage GT, that is, whether the printing can be executed without running out of the ink (step S60) only when it is determined that the remaining amount S of the ink in any ink cartridge 25 is less than or equal to the monitor judgment amount R (see step S15 of FIG. 6). Therefore, the computer 11 determines that the ink cartridge 25 having great remaining amount S will not run out without calculating the approximate ink usage GT obtained by analyzing the printing data. Thus, the printing time is further reduced.

A printing system according to a fourth embodiment of the present invention, which serves as a liquid spraying apparatus, will now be described with reference to FIGS. 10 and 11. In the fourth embodiment, the processes corresponding to a portion surrounded by a chain double-dashed line in FIG. 6 is replaced with the processes shown in FIG. 11. The processes that are same as the third embodiment will be described with reference to FIGS. 4, 6, and 8.

If the decision outcome of step S15 is negative, that is, if it is determined that there is no ink cartridge 25 that has a remaining amount S of ink that is less than or equal to the monitor judgment amount R, the computer 11 proceeds to step S151. In step S151, the computer 11 prepares the printing data and proceeds to step S16. In step S16, the computer converts the printing data to the intermediate image data and executes steps S17 to S24 of FIG. 4.

On the other hand, if the decision outcome of step S15 is positive, that is, if it is determined that there is a ink cartridge 25 that has a remaining amount S of ink that is less than or equal to the monitor judgment amount R, the computer 11 proceeds to step S50. The computer 11 calculates the approximate amount GT in the following manner. As shown in FIG. 10, when the print execution command is entered, the computer 11 prepares a reduced print data for printing on the sheet of paper P having a quarter size of the specified sheet of paper P. That is, in step S506, the computer 11 prepares the printing data for printing on a sheet of A6 paper, which is the quarter size of the sheet of paper P of size A4.

In step S507, the computer 11 analyzes the printing data for printing on the sheet of A6 paper and calculates the reduced data analysis amount SU of each ink required for printing on the sheet of A6 paper. In step S508, the computer 11 calculates the approximate ink usage GT by multiplying the reduced data analysis amount SU by four.

Figure 11:
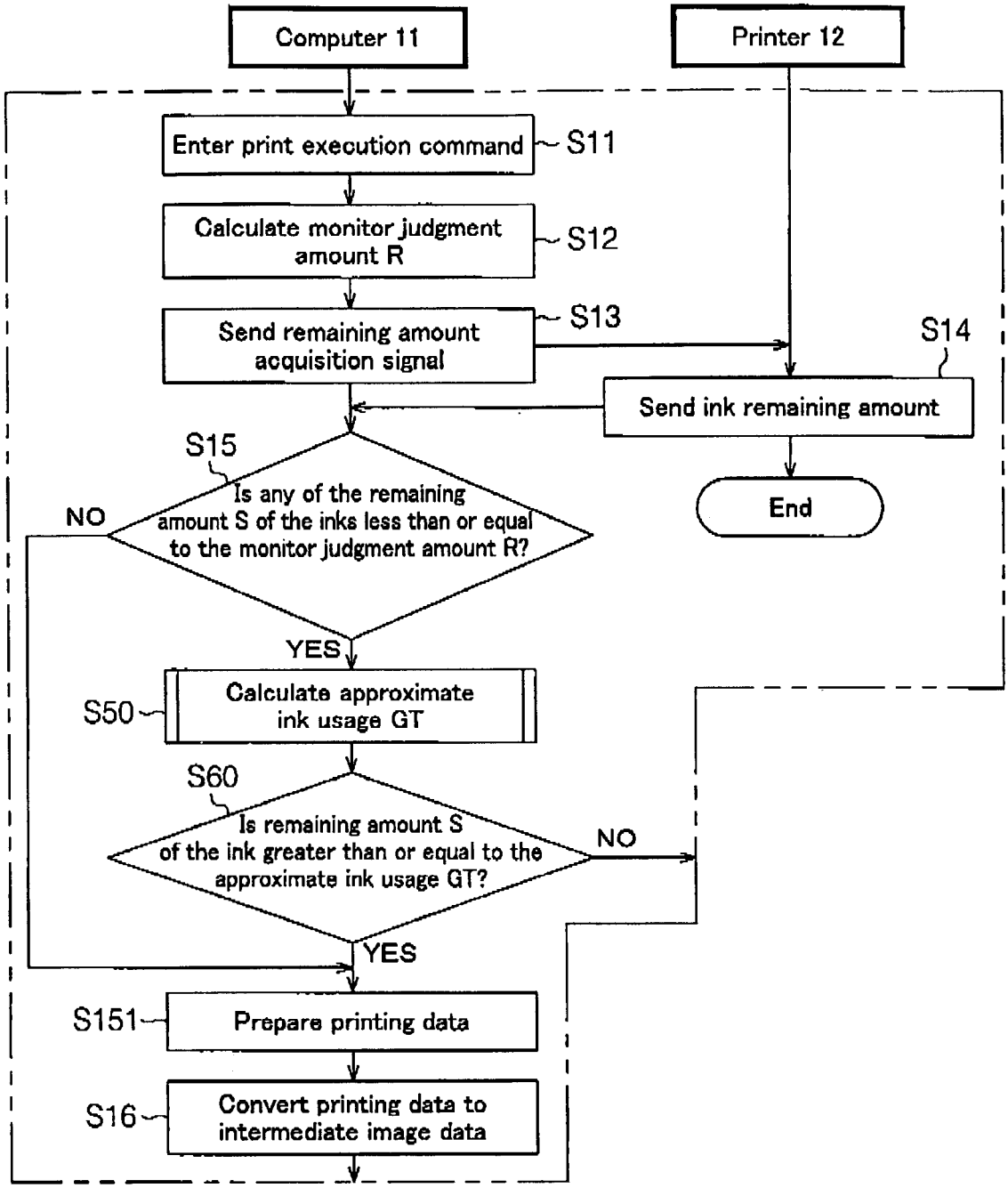
FIG. 11 is a flowchart illustrating a printing routine up to the calculation of the approximate ink usage according to the fourth embodiment of FIG. 10.

As shown in FIG. 11, in step S60, the computer 11 determines whether the remaining amount S that is determined to be less than the monitor judgment amount R in step S15 is greater than or equal to the approximate ink usage GT. If the decision outcome of step S60 is positive, that is, if it is determined that all the inks that are determined to have a remaining amount S that is less than the monitor judgment amount R are greater than the approximate ink usage GT, the computer 11 proceeds to step S151. In step S151, the computer 11 prepares the printing data and executes processes of steps S16 to S24 of FIG. 4.

On the other hand, if the decision outcome of step S60 is negative, that is, if it is determined that the remaining amount S of the ink is less than the monitor judgment amount R and is less than the approximate ink usage GT (or not greater than or equal to the approximate ink usage GT), the computer 11 proceeds to step S70 shown in FIG. 6.

The fourth embodiment provides the following advantages in addition to the advantages of the third embodiment shown in FIGS. 6 to 8.

Figure 10:
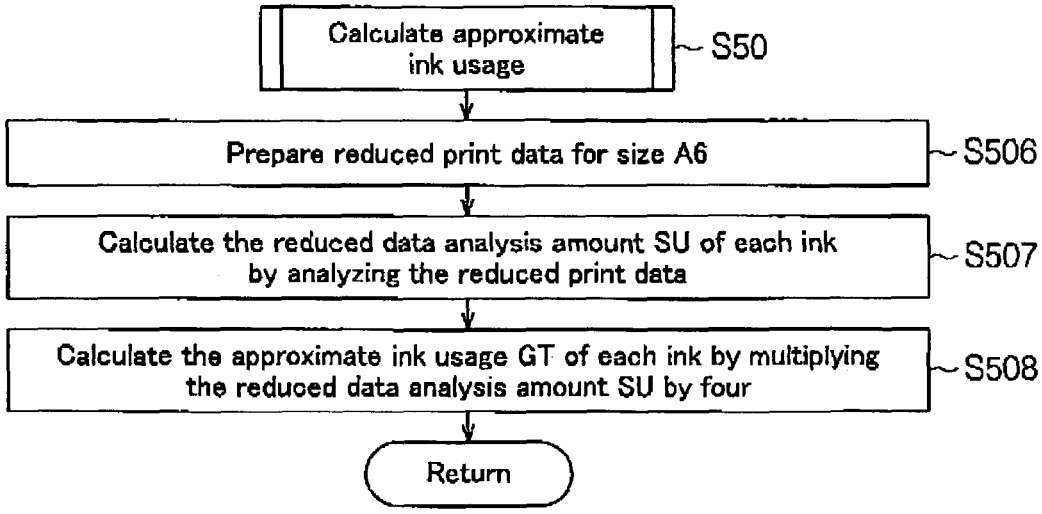
FIG. 10 is a flowchart illustrating a calculation routine of an approximate ink usage according to a fourth embodiment of the present invention.

The computer 11 prepares the printing data for printing on the A6 paper, which is the quarter size of the A4 paper (see step S256 of FIG. 10). The computer 11 analyzes the printing data and obtains the reduced data analysis amount SU (see step S507), which is multiplied by four to obtain the approximate ink usage GT (see step S508). Therefore, since the approximate ink usage GT is calculated by analyzing the fourth part of the printing data to be actually printed, the load on the computer 11 is reduced and the printing time is reduced. Further, the approximate ink usage GT obtained in the fourth embodiment is calculated based on the printing data when the image to be printed is reduced in size. Thus, the calculated ink usage and the ratio of each color of ink is substantially the same as the ink usage and the ratio in the actual printing. As a result, in addition to reducing the printing time, the ink insufficiency is more accurately determined.

It should be apparent to those skilled in the art that the present invention may be embodied in many other specific forms without departing from the spirit or scope of the invention. Particularly, it should be understood that the invention may be embodied in the following forms.

In the embodiments of FIGS. 1 to 11, the processes performed by the computer 11 may be executed by the printer 12. In this case, the computer 11 is unnecessary.

The embodiments of FIGS. 1 to 11 may be applied to a printer 12 in which the ink cartridges 25 are not mounted to the carriage 20, that is, to a printer that has a fixed ink cartridge 25 and that prints on a large sheet of paper P.

In the embodiments of FIGS. 1 to 11, the monitor judgment amount R is variable in accordance with the size of the sheet of paper P and the number of pages to be printed. However, the monitor judgment amount R may be a constant value.

In the embodiments of FIGS. 1 to 11, the monitor judgment amount R may vary depending on each ink. In this case, for example, the computer 11 sets a high monitor judgment amount R for the ink that has the great estimated ink usage T (such as cyan ink when printing an image of sea or sky). Thus, the ink that is likely to run out is monitored from the early stage to detect the ink shortage promptly. The computer 11 also sets a low monitor judgment amount R for the ink that has the small estimated ink usage T. Thus, the ink that is not likely to run out is not monitored as much as possible. Therefore, each color of ink is monitored in a more suitable manner by changing the monitoring time depending on each color of ink. This reduces the load on the printer 12 and permits the computer 11 to detect the ink shortage promptly.

In the embodiments of FIGS. 1 to 11, the remaining amount S of the ink is stored in the non-volatile memory 25*a* of the ink cartridge 25 of the printer 12 after printing is completed (see step S22 of FIG. 4). However, the actual ink usage W may be stored in each non-volatile memory 25*a*. In this case, the computer 11 calculates the remaining amount S of the ink from the actual ink usage W before printing.

In the embodiments of FIGS. 1 to 11, the remaining amount S may be stored in the CPU 45 of the printer 12 or the computer 11.

In the first and second embodiments of FIGS. 1 to 5, if there is more than one color of ink that has a remaining amount S which is less than the monitor judgment amount R, the monitoring process (step S20) is performed in the order from the ink the remaining amount S is small. However, the sequence of the colors of ink to go through the monitoring process may be, for example, specified by the user in accordance with the image data to be printed.

In the embodiments of FIGS. 1 to 11, the spraying amount of the printer 12 may be varied such that the droplet size of the ink is 20 pl, 10 pl, and 6 pl, or 39 pl, 7 pl, 4 pl. The printer 12 may have all kinds of the above mentioned spraying amount. In this case, the spraying amount that is reduced during save printing is set in more detail. Thus, the printed image is closer to the image printed when the ink is sufficient.

Figure 12:
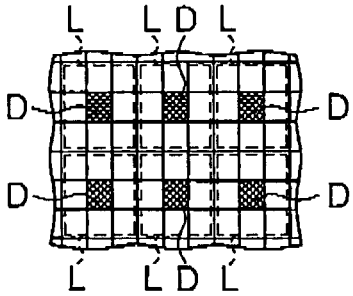
FIG. 12 is an explanatory diagram illustrating the position of extracted data for calculating an approximate ink usage according to a modified embodiment of the present invention.

In the third embodiment of FIGS. 6 to 9, the approximate ink usage GT is calculated based on the analysis target portion data extracted every four lines from the printing data. Instead of extracting the data per line, the data may be extracted per dot (dots are arranged in the sub-scan direction when the sheet of paper P is printed). As shown by a modified example of FIG. 12, one dot (a dot D at the center in FIG. 12) may be extracted from a predetermined area L (3 dots×3 dots in FIG. 12). Further, the analysis target portion data may be accordingly extracted from part of the raster data, which is the form of printing data when transmitted from the computer 11 to the printer 12.

In the third embodiment of FIGS. 6 to 9, the analysis target portion data need not be extracted every four lines as long as the data is obtained as the nth part (n is a positive integer) of the printing data.

In the third embodiment of FIGS. 6 to 9, the analysis target portion data is extracted every predetermined number of lines. However, the analysis target portion data may be extracted at random.

In the fourth embodiment of FIGS. 10 and 11, the computer 11 prepares the reduced data to be printed on the sheet of paper that is the quarter size of the sheet of paper P to be actually printed. The computer 11 then analyzes the reduced data to calculate the approximate ink usage GT. The size of the reduced data is not limited to the quarter size. If the image can be reduced as the image that is substantially the same as the image that is actually printed, the approximate ink usage GT that is close to the actual ink usage T required during the actual printing is obtained.

The printer (printing apparatus including facsimile, copying machine, and the like) for spraying ink is described as a liquid spraying apparatus in the above embodiments. However, the present invention may be applied to a liquid spraying apparatus for spraying other liquid. For example, a liquid spraying apparatus for spraying liquid such as electrode material or color material used for manufacturing a liquid crystal display, an EL display, and a surface emitting display, a liquid spraying apparatus for spraying living organic material used for manufacturing bio chip, or a precision pipette, which is a sample spraying apparatus.

Therefore, the present examples and embodiments are to be considered as illustrative and not restrictive and the invention is not to be limited to the details given herein, but may be modified within the scope and equivalence of the appended claims.

The invention claimed is:

1. A liquid spraying method for spraying liquid from inside a plurality of liquid containers through a liquid spraying head to a target in accordance with a predetermined spraying procedure, the method comprising:

determining, upon receipt of a print request, and before printing begins, whether a remaining amount of liquid inside each of the liquid container is less than or equal to a reference value;

executing a monitoring process of liquid only when the remaining amount of liquid inside at least one liquid container before printing begins is less than or equal to the reference value; wherein the monitoring process of liquid comprises:

calculating a usage of liquid required for the spraying procedure; and determining whether the calculated usage of liquid is less than or equal to the remaining amount of liquid;

wherein, when there is only one liquid container that has a remaining amount of liquid that is less than or equal to the reference value, the monitoring process of liquid is executed on only the liquid container that has a remaining amount of liquid that is less than or equal to the reference value;

wherein, when there is more than one liquid container that has a remaining amount of liquid that is less than or equal to the reference value, the monitoring process of liquid is executed on at least a liquid container that has a smallest remaining amount of liquid; and wherein the target is one of a plurality of targets, and wherein the reference value is variable, based on the size of the target and the number of targets.

2. The liquid spraying method according to claim 1, wherein, when there is more than one liquid container that has liquid having a remaining amount that is less than or equal to the reference value, the monitoring process is executed on only the liquid container that has the smallest remaining amount of liquid.

3. The liquid spraying method according to claim 1, wherein, when there is more than one liquid container having a remaining amount of liquid that is less than or equal to the reference value, the monitoring process is executed in order from the liquid container that has the smallest remaining amount.

4. The liquid spraying method according to claim 1, wherein the plurality of liquid containers each contain different kinds of liquid, and wherein the reference value can be set per each kind of liquid.

5. The liquid spraying method according to claim 1, further comprising calculating the reference value by multiplying a calculation reference amount by a number of pages to be printed, wherein the calculation reference amount by a used when an entire printing area of a sheet of paper is printed with one color of ink.

6. A liquid spraying system for spraying liquid to a target, the liquid spraying system comprising:

a liquid spraying head, wherein the liquid spraying head has a nozzle;

a plurality of liquid containers connected to the liquid spraying head and containing liquid, wherein the liquid containers spray the liquid from the nozzle to the target in accordance with a predetermined spraying procedure;

a remaining amount detecting apparatus for detecting a remaining amount of liquid in each of the liquid containers;

a determining apparatus for determining, upon receipt of a print request, and before printing begins, whether the remaining amount of liquid in each of the liquid containers is less than or equal to a predetermined reference value;

a usage calculating apparatus for calculating usage required for the spraying procedure of the liquid only when the remaining amount of liquid in at least one liquid container before printing begins is determined to be less than or equal to the reference value; and a comparing apparatus for comparing the detected remaining amount of the liquid with the calculated usage only when the remaining amount of liquid in at least one liquid container before printing begins is determined to be less than or equal to the reference value, wherein, when there is more than one liquid container that has a remaining amount of liquid that is less than or equal to the reference value, the usage calculating apparatus calculates usage with respect to at least a liquid container having a smallest remaining amount of liquid; and wherein the target is one of a plurality of targets, and wherein the system further comprises a setting apparatus for setting the reference value based on the size of the target and the number of targets.

7. The liquid spraying system according to claim 6, wherein, when there is more than one liquid container that has a remaining amount of liquid that is less than or equal to the reference value, the usage calculating apparatus calculates the usage with respect to only the liquid container that has the smallest remaining amount of liquid.

8. The liquid spraying system according to claim 6, wherein, when there is more than one liquid container that has a remaining amount of liquid that is less than or equal to the reference value, the calculating apparatus calculates the usage in order from the liquid container having the smallest remaining amount of liquid.

9. The liquid spraying system according to claim 6, further comprising:

a remaining amount calculating apparatus, wherein, when liquid spraying, which is performed in accordance with the spraying procedure, is completed, the remaining amount calculating apparatus calculates the remaining amount of liquid based on the usage of the liquid used during the liquid spraying; and a remaining amount storing apparatus for storing the calculated remaining amount of liquid.

10. The liquid spraying system according to claim 6, wherein the predetermined reference value is calculated by multiplying a calculation reference amount by a number of pages to be printed, wherein the calculation reference amount is the amount of ink used when an entire printing area of a sheet of paper is printed with one color of ink.

11. A program for causing a computer, which controls a liquid spraying apparatus, to function, wherein the liquid spraying apparatus includes a plurality of liquid container, each of which contains liquid, and sprays the liquid through a liquid spraying head to a target in a predetermined spraying procedure, the program comprising:

detecting a remaining amount of liquid in each of the liquid containers;

determining, upon receipt of a print request, and before printing begins, whether the remaining amount of liquid in each of the liquid containers is less than or equal to a predetermined reference value;

calculating usage of liquid only when the remaining amount of liquid in at least one liquid container before printing begins is determined to be less than or equal to the reference value, wherein the usage is the amount of liquid required for the spraying procedure; and with respect to the liquid having a detected remaining amount before printing begins, which is determined to be less than or equal to the reference value, comparing the remaining amount of liquid with the calculated usage, wherein, when there is more than one liquid container that has a remaining amount of liquid that is less than or equal to the reference value, the usage of liquid is calculated with respect to at least a liquid container having a smallest remaining amount of liquid; and wherein the target is one of a plurality of targets, and wherein the program further causes the computer to set the reference value based on the size of the target and the number of targets.

12. The program according to claim 11, wherein, when there is more than one liquid container that has a remaining amount of liquid that is less than or equal to the reference value, the usage of liquid is calculated with respect to only the liquid container having the smallest remaining amount of liquid.

13. The program according to claim 11, wherein, when the is more than one liquid container that has a remaining amount of liquid that is less than the reference value, the usage of liquid is calculated in the order from the liquid container that has the smallest remaining amount of liquid.

14. The program according to claim 11, further comprising:

when liquid spraying, which is performed in accordance with the spraying procedure, is completed, calculating the remaining amount of liquid based on the usage of liquid used during the liquid spraying; and storing the calculated remaining amount of liquid.

15. The program according to claim 11, further comprising calculating the predetermined reference value by multiplying a calculation reference amount by a number of pages to be printed, wherein the calculation reference amount is the amount of ink used when an entire printing area of a sheet of paper is printed with one color of ink.

* * * * *